United States Patent [19]

Praba et al.

[11] Patent Number: 4,906,952

[45] Date of Patent: Mar. 6, 1990

[54] ASYMMETRIC WAVEGUIDE LOAD

[75] Inventors: Krishna Praba, Camden County; Stephen Scalph, Monmouth County, both of N.J.

[73] Assignee: General Electric Company, East Windsor, N.Y.

[21] Appl. No.: 746,311

[22] Filed: Jun. 19, 1985

[51] Int. Cl.[4] ..... H01P 1/26

[52] U.S. Cl. ..... 333/22 R; 333/248

[58] Field of Search ..... 333/22 R, 22 F, 113, 333/114, 248

[56] References Cited

U.S. PATENT DOCUMENTS

| | | | |
|---|---|---|---|
| 2,594,874 | 4/1952 | Cohn et al. | 333/22 R |
| 2,635,145 | 4/1953 | Luhrs | 333/22 R |
| 2,682,641 | 6/1954 | Sensiper | 333/22 R X |
| 2,684,469 | 7/1954 | Sensiper | 333/22 R X |
| 2,812,500 | 11/1957 | Riblet | 333/22 R X |
| 3,036,280 | 5/1962 | Woodcook | 333/22 R |
| 3,904,993 | 9/1975 | James | 333/22 R |
| 3,914,714 | 10/1975 | Johnson | 333/22 R |
| 4,516,088 | 5/1985 | Johnson et al. | 333/22 F |

FOREIGN PATENT DOCUMENTS

| | | | |
|---|---|---|---|
| 2574790 | 10/1950 | United Kingdom | 333/113 |

OTHER PUBLICATIONS

Jerrold Modline 70 Instruction Sheet.

*Primary Examiner*—Eugene R. LaRoche
*Assistant Examiner*—Benny Lee
*Attorney, Agent, or Firm*—William H. Meise

[57] ABSTRACT

A waveguide termination includes a rectangular waveguide having a pair of spaced-apart broad walls and a pair of narrow walls equally spaced from a plane of symmetry. The termination has a block or wedge of absorber material. The width of the absorber material is approximately half the width of the waveguide as measured between the narrow walls. The absorber material is located asymmetrically in the waveguide so that substantially all of the absorber material is on one side of the plane of symmetry.

14 Claims, 6 Drawing Sheets

ASYMMETRIC WAVEGUIDE LOAD

BACKGROUND OF INVENTION

This invention relates to waveguides for propagating electromagnetic energy and more particularly to energy-absorbing terminations for waveguide.

Modern communications systems require ever increasing bandwidths in order to accommodate the increasing amount of data being handled. As signal bandwidths increase, the frequencies of carriers upon which these signals are superimposed have become increasingly higher. At carrier frequencies below 100 Megahertz (MHz), transmission lines are for the most part in the form of coaxial cable or open-wire transmission lines. In the region between 100 MHz and about 8 Gigahertz (GHz), coaxial cables and waveguides both find use, with waveguides being used for those applications requiring lower loss or high power handling capability. At X-band (8.2 to 12.4 GHz) and beyond, the use of waveguides predominates over the use of coaxial cable. Waveguides are currently commercially manufactured for use at frequencies up to 140 GHz.

Complex waveguide assemblies are used for many purposes and find special use in communications satellites. For example, a microwave solid state transmitter for a satellite may be implemented by means of a large number of solid state power sources, each producing a few watts of signal energy which is either generated in or coupled into a waveguide. The signals from these power sources are combined by a "tree" type of waveguide power combiner, in which the power from the signal sources is applied in pairs, equal in amplitude and quadrature in phase, from the signal sources to inputs of waveguide directional couplers. Each directional coupler has two input ports and an output port, and also has a terminated waveguide port. Each directional coupler combines the signal powers which are equal and in quadrature, from the two input waveguides and sums their power in a single output waveguide. In this fashion, the signals from eight solid-state power sources applied by eight waveguides to four directional couplers may be added in pairs to produce twice the amount of power in each of four waveguides. The four waveguides are coupled in pairs to the inputs of two further directional couplers, which combine the signal powers into two waveguides which are coupled to a final directional coupler, which combines the last pair of signals onto a single waveguide. Such an arrangement requires N-1 directional couplers to combine the signal from N input waveguides. It will be understood that when the signal from large numbers of waveguides is to be combined, many directional couplers and a substantial number of waveguide connections are required. When such an assemblage is to be used on a satellite, it is imperative that the size and weight be minimized. It is clear that conventional "plumbing" assembly, in which each waveguide component has individual waveguide connection flanges interconnected by suitable waveguide lengths and elbows, has excessive weight due to the interconnection waveguides and flanges, and also has excess volume because of the space between waveguide components. A more satisfactory fabrication technique for an assemblage of waveguide components is to mill the entire waveguide assembly into a solid "monolithic" block of metal, and insert the requisite components. It is convenient when fabricating such as assemblage to fabricate two mating halves of a block which when mated together define both the waveguide components and their interconnection waveguides.

Among the waveguide elements required for use with a directional coupler is a terminating load. Such loads are intended to absorb all the energy flowing through a waveguide without reflection. When the two inputs are in phase quadrature, no energy flows into the terminating load. However, for any inequality in the amplitude of the inputs, or for any phase error, energy flows into the terminating load and must be absorb to reduce reflects back to the input. In the prior art, as described for example in U.S. Pat. No. 3,904,993 issued Sept. 9, 1975, to James, the waveguide load consists of a wedge of energy absorbing or lossy material located in and extending across the full width (larger cross-sectional dimension) of the rectangular waveguide. In the James arrangement, conductive septums are located within the lossy material to aid in carrying away heat. It has been found that such prior art terminations create difficulties in assembling the two mating portions of a waveguide assemblage such as that previously described. For example, an 8-way power combiner including seven directional couplers requires seven waveguide terminations or loads. As mentioned, the prior art energy absorbing material extends across the full width of the waveguide. The energy absorbing wedges, once cut to size, can be inserted into the proper location in one of the halves in the assembly. The wedges are retained in that location by use of adhesive. When so assembled, each wedge protrudes above the half of the waveguide into which it is inserted by a full half width of the waveguide. Thereafter, the mating half of the assemblage is placed on the half containing the absorbent wedges. It has been found to be extremely difficult to simultaneously fit all of the wedges into the mating halves of the waveguide. This difficulty exists even when the absorbent wedges are formed from a material which is resilient, such as an elastic foam. This problem is exacerbated if those portions of the absorbent material which are intended to be in contact with the walls of the mating waveguide are coated with adhesive. Even if assembly can be accomplished, the adhesive once cured prevents disassembly of the two halves of the waveguide assemblage and, if the assembly is forcibly disassembled, tears the absorbent material in a manner making reassembly difficult.

A waveguide termination arrangement is desired which is amenable to convenient assembly and disassembly of the mating halves of a waveguide assemblage.

SUMMARY OF THE INVENTION

A waveguide arrangement includes a rectangular waveguide defined by first and second elongated conductive narrow walls equally spaced from a first plane of symmetry. First and second conductive broad walls connect the edges of the first and second narrow walls to each other. The first and second broad walls are equally spaced from a second plane of symmetry. The intersection of the first and second plane of symmetry defines an axis of the rectangular waveguide. A conductive shorting wall is oriented orthogonal to the axis and in contact with the first and second narrow walls and with the first and second broad walls for short circuiting the rectangular waveguide at a shorting plane. An energy absorbing termination includes a wedge-shaped energy absorber which has a length, a constant width approximately equal to half the width of one of the broad walls, and a height which tapers monotonically from a maximum dimension equal to the width of one of the narrow walls to a minimum dimension substantially equal to zero over the length of the absorber. The wedge shaped energy absorber is located within the rectangular waveguide on-one side of the first plane of symmetry with the maximum dimension of the wedge nearest the conductive shorting wall. Thus, the bulk of the absorbent material is on the one side of the first plane of symmetry, leaving the other side of the first plane of symmetry substantially free of any energy absorber. In accordance with another aspect of the invention, a method for fabricating a waveguide arrangement includes the steps of forming a first half of a conductive rectangular waveguide divided along a plane of symmetry passing through the axis of the waveguide. A complementary half of the elongated conductive rectangular waveguide is also formed. A tapered energy absorber is fastened in the first half of the waveguide in such a fashion that the bulk of the absorbent material lies within the first half of the waveguide and no more than a small portion of the absorber extends past the plane of symmetry. Finally, the first and second halves of the rectangular waveguide are assembled.

DESCRIPTION OF THE INVENTION

Figure 1A:
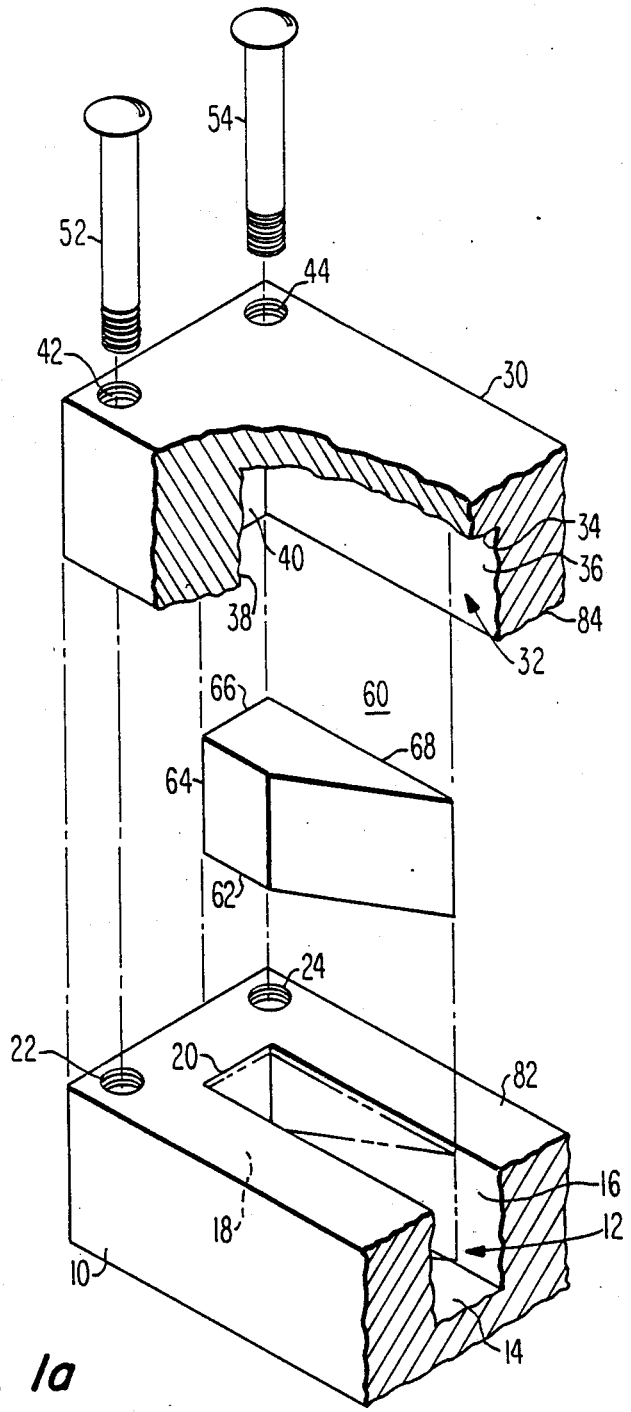
FIG. 1*a* is an exploded isometric view of a waveguide termination according to an embodiment of the invention.

FIG. 1*a* is an exploded view of a waveguide termination. In FIG. 1*a* a block of metal designated 10 has a slot 12 milled therein which has dimensions related to the size of the desired waveguide. Slot 12 defines a narrow wall 14 and broader mutually parallel walls 16 and 18 orthogonal to narrow wall 14. Slot 12 ends at a wall 20 which contacts narrow wall 14 and broader walls 16 and 18 and it is orthogonal to all three. First and second apertures 22 and 24 are tapped for screw threads.

A second conductive block 30 is milled with a slot 32 complementary to slot 12 and of similar dimensions. Slot 32 has a relatively broad wall 36 facing a second relatively broad wall 38 (most of which is cut away in FIG. 1*a*) separated by a narrow wall 34. A rear wall 40 is orthogonal to walls 32, 34, and 38. Through holes 42 and 44 formed in block 30 are clearance holes for screws 52 and 54 respectively, which are threaded to match the threads of apertures 22 and 24.

When blocks 10 and 30 are assembled together with screws 52 and 54, milled slots 12 and 32 match and together define an elongated section of rectangular waveguide having spaced apart parallel narrow walls 14 and 34, the edges of which are joined by spaced apart parallel broad walls 16, 36 and 18, 38. Walls 20 and 40 together define a short circuit at the end of the waveguide section.

As known, a matched or energy absorbing termination requires energy absorbing material. As illustrated in FIG. 1, the energy absorbing material is in the form of a lossy block 60 of resilient absorbing material. A suitable material is Eccosorb MF-124, manufactured by Emmerson & Cuming whose address is Canton, MA 02021. Block 60 is a homogeneous block of material but may be considered to be made up of a rectangular block 90 and a wedge 92 (FIG. 1*d*). Rectangular block 90 has a length in the long direction of the rectangular waveguide equal to the length of side 62, a width (w) equal to the length of side 64 and a height (h) equal to the height of side 66. Width 64 and height 66 are selected to be approximately equal to the width and height of walls 16 and 14, respectively. Wedge shaped portion 92 of block 60 has a width equal to the dimension of side 64, a height which tapers from the dimension of side 66 to a dimension substantially equal to zero, and an axial length which may be defined as the length of side 68 minus the length of side 62. As illustrated by the dotted assembly lines (FIG. 1*a*), absorber block 60 when assembled is fitted within block 10.

During assembly, those faces of absorber block 60 which when assembled are in intimate contact with walls 16, 18 or 20 are coated with conducting adhesive such as silver-loaded cement to retain the absorber block firmly in place and to aid in providing heat transfer between absorber block 60 and thermally conductive block 10. Complementary block 30 is then mated with block 10, and the screws are then fastened in place to form the completed assembly.

Figure 1B:
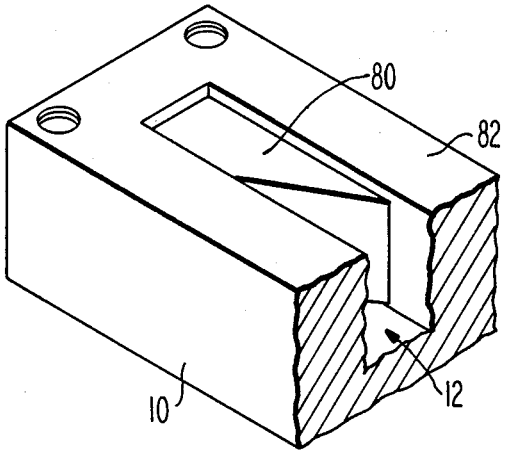
FIG. 1*b* and 1*c* are views of a portion of the termination with absorber block sizes according to alternative embodiments of the invention.
Figure 1D:
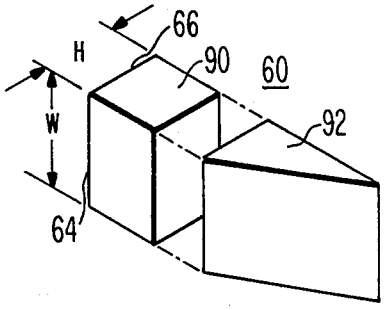
FIG. 1*d* is a view of the absorber block degenerated into block and wedge components.

FIG. 1*b* illustrates conductive block 10 with milled slot or waveguide portion 12, and with a tapered block 80 of energy absorbent material located within the waveguide portion. The dimensions of block 80 are such that when assembled, the block does not protrude above face 82 of block 10. This arrangement guarantees that during the assembly of mating blocks 10 and 30 there can be no interference whatever due to protruding absorber.

Figure 1C:
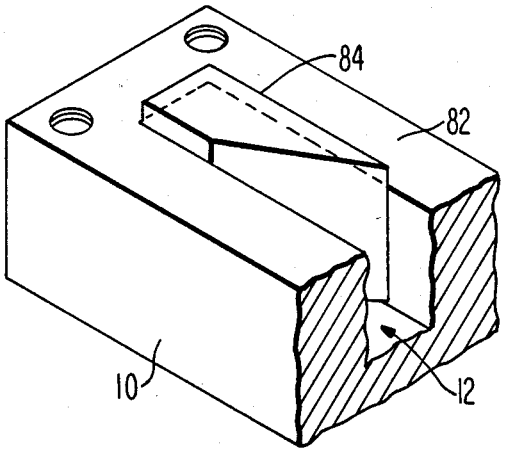

FIG. 1*c* illustrates block 10 and milled slot or waveguide portion 12 assembled with block 84 of energy absorbent material. As illustrated in FIG. 1*c*, energy absorbent block 84 is dimensioned so that a small amount protrudes above surface 82. Such an arrangement is not quite so convenient to assemble with its mating block 30 as are the arrangements of FIG. 1*a* or 1*b*.

Figure 2B:
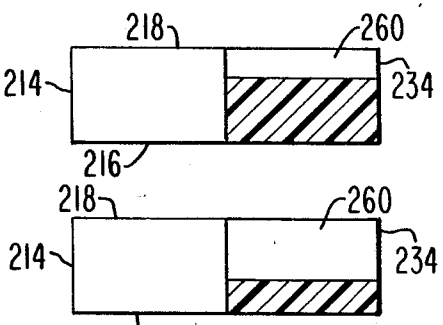
FIGS. 2*b* and 2*c* are sections illustrating the shape of the absorber.
Figure 2C:
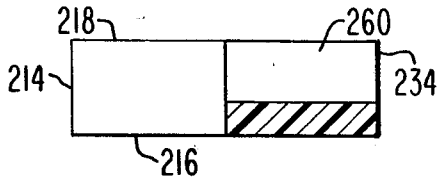
Figure 2A:
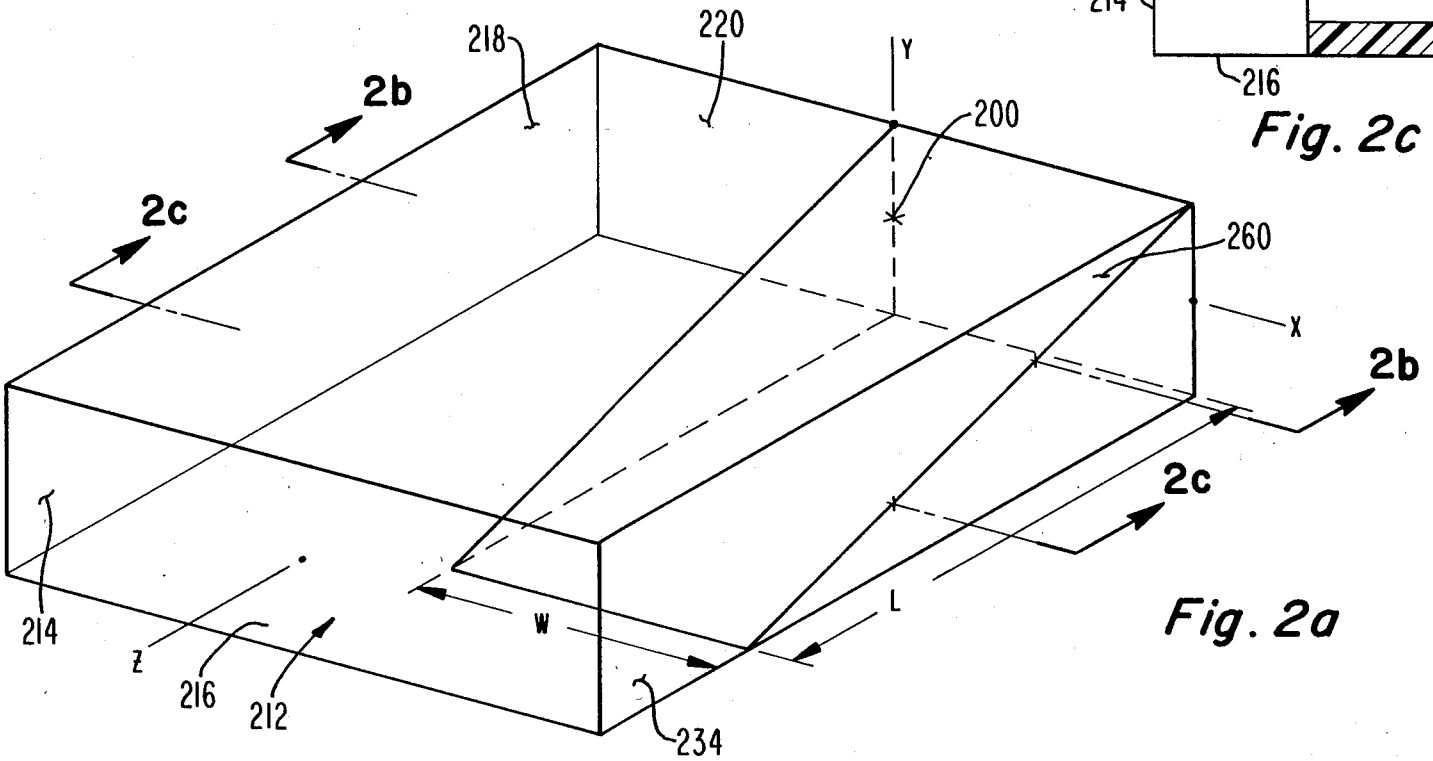
FIG. 2*a* is a phantom isometric view of a waveguide termination according to the invention, including an energy absorber within a waveguide, illustrating section planes.

FIG. 2*a* illustrates a waveguide termination in phantom isometric view. In FIG. 2*a*, X,Y and Z axes originate at a point 200. Narrow conductive walls 214 and 234 are equidistant from the Y-Z plane, and broad conductive walls 216 and 218 are equally spaced from the X-Z plane and interconnect the edges of narrow walls 214 and 234. A conductive plate or wall 220 lies in the X-Y plane and makes contact with narrow walls 214 and 234, and with broad walls 216 and 218. A wedge shaped block of energy absorbent material is designated 260. As illustrated in FIG. 2*a*, absorber block 260 lies entirely on the +x side of the Y-Z plane. Absorber block 260 has a width W, a length L, and height in the Y direction which has its maximum value in the X-Y plane and which tapers along its length to substantially zero at length L. Walls 214, 216, 218 and 234 define a waveguide input port illustrated as 212 adapted to be coupled to a source of signal.

FIG. 2*b* illustrates in cross sectional view the arrangement of FIG. 2*a* sectioned parallel with X-Y plane along line B—B. FIG. 2*c* illustrates the arrangement of FIG. 2*a* sectioned parallel with the X-Y plane along the line C—C. As illustrated in FIGS. 2*b* and 2*c*, the wedge shape of absorber 260 results in a rectangular cross section in planes parallel to the X-Y plane.

As illustrated in FIGS. 1*a*, 1*b*, 1*c* and in FIGS. 2*a*, 2*b* and 2*c*, the dimension of the energy absorbent material which changes as a result of taper is the dimension parallel with the Y axis. In the dominant $TE_{10}$ operating mode of a rectangular waveguide, the electric field is parallel with the Y axis. Consequently, the taper as illustrated may be said to be in direction of the E-plane of the waveguide.

Figure 3:
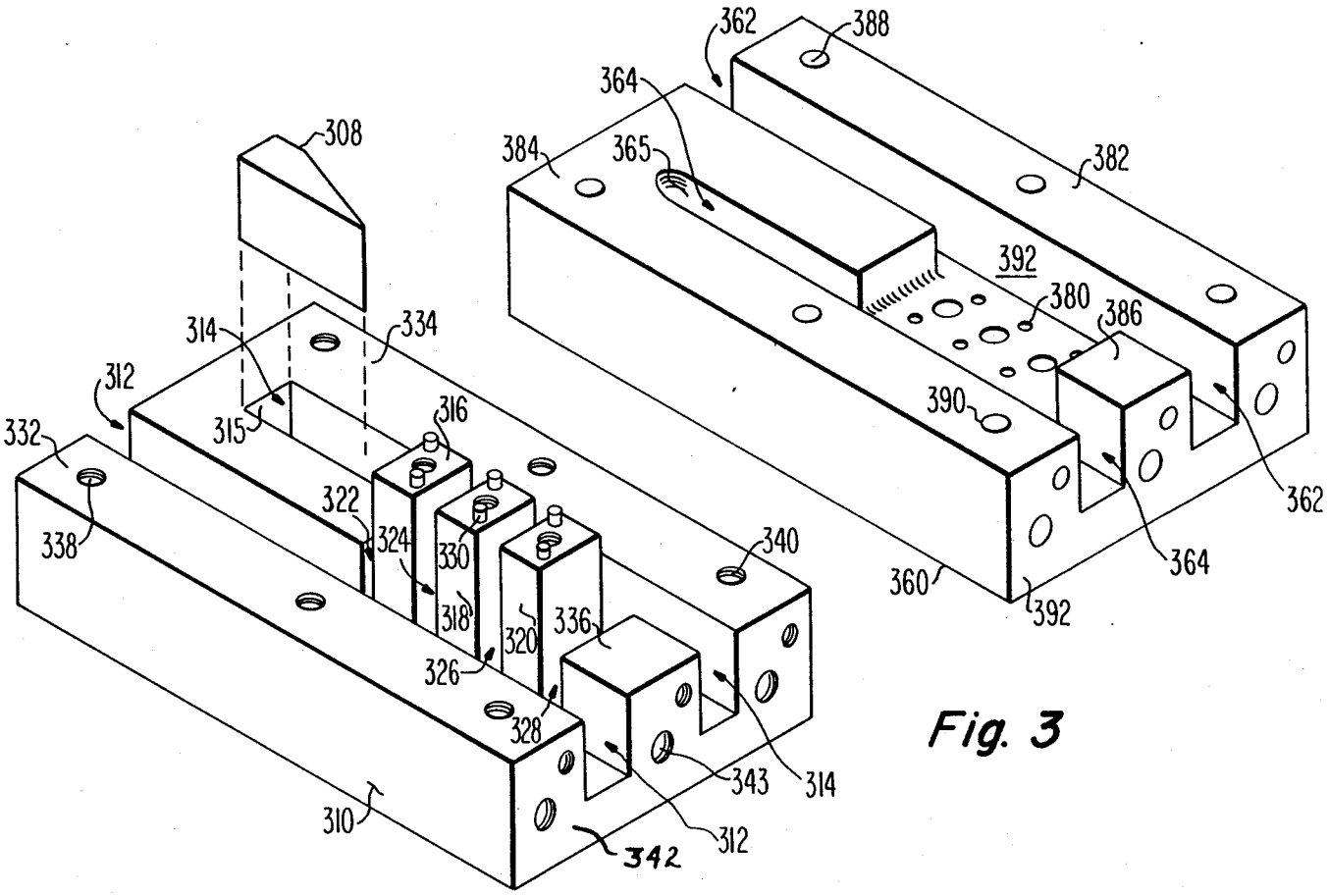
FIG. 3 is a perspective view of portions of a waveguide assemblage which together define a four branch directional coupler and a waveguide termination or load according to the invention.

FIG. 3 illustrates a four branch directional coupler including a waveguide termination. In FIG. 3, a first conductive block 310 is milled with longitudinal rectangular slots or waveguide portions 312 and 314. Waveguide portion 312 extends all the way through block 310, while waveguide portion 314 extends from face 342 to a shorting wall 315. A further portion of block 310 is milled out in the region between slots 312 and 314 to accommodate three conductive blocks 316, 318 and 320 which when assembled together with block 310 define branch waveguide portions 322, 324, 326 and 328 extending from waveguide portion 312 to waveguide portion 314. Blocks 316, 318, 320 include locating pins, one of which is designated 330, on their upper sides. Block 310 has a top surface portion 332 defining three threaded apertures, one of which is designated 338. Block 310 also defines a further flat surface 334 having three threaded apertures therein, one of which is designated 340. Further, block 310 defines another top surface 336.

A block 308 of energy absorber material similar in shape to block 60 of FIG. 1 is illustrated outside of waveguide portion 314 to make its shape and orientation clear. Block 308 is adhesively bonded within waveguide slot 314 adjacent to short circuiting wall 315 as indicated by dotted projection lines.

A further conductive block 360 complementary to block 310 when assembled thereto forms the waveguide branch coupler and energy absorbing termination. Block 360 is milled with a rectangular through slot 362 which defines flat top surfaces 382 and 384 which mate with surfaces 332 and 334. A slot 364 terminating at a short circuiting wall 365 complements slot 314 and short circuiting wall 315 and together therewith forms a second waveguide. A portion designated generally as 392 of block 360 is miled out in the region between slots 362 and 364 to accommodate blocks 316, 318 and 320. A plurality of apertures, one of which is designated 380, in milled-out portion 392 mate with locating pins 330 to accurately locate blocks 316–320 to define the branch waveguides of the directional coupler. Slots 362 and 364 define a flat top surface 386 which when assembled with block 310 mates with surface 336 respectively. Also, clearance holes 388 and 390 provide access to threaded holes 338, 340 for screws (not illustrated) which hold the entire assembly together. When assembled, blocks 310 and 360 define a waveguide branch directional coupler and associated termination having a pair of waveguide input ports on the surface formed by combining surfaces 342 of block 310 and 392 of block 360. The apertures in surfaces 332 and 392 accept locating pins and screws from adjacent mating waveguide sections (none of which are illustrated in FIG. 3).

As mentioned previously, an 8-way power combiner requires a tree structure of seven directional couplers and associated terminations. Thus, a complete combiner would be formed from two blocks, a bottom block encompassing four arrangements such as 310 side-by-side, stacked end-to-end with the side-by-side combination of two assemblages such as 310, further stacked end-to-end with one further arrangement 310. Such a large assemblage has a large number of locating pins and screws to be mated during assembly. Such a power combiner may be assembled and disassembled many times during various procedures associated with tests and readiness for space use. If prior art terminators were to be used, absorber block 308 would extend substantially across the full width of the waveguide. It will be appreciated that preventing deformation of the resilient absorbent material during repeated assembly of a large structure encompassing many of the FIG. 3 units would present a substantial problem. Further, the problem of providing good thermal coupling of the absorbent material to the adjacent metallic structures further complicates the assembly and disassembly problem. This is especially true if adhesive methods are used for bonding the absorbent block to the adjacent surfaces.

Figure 4:
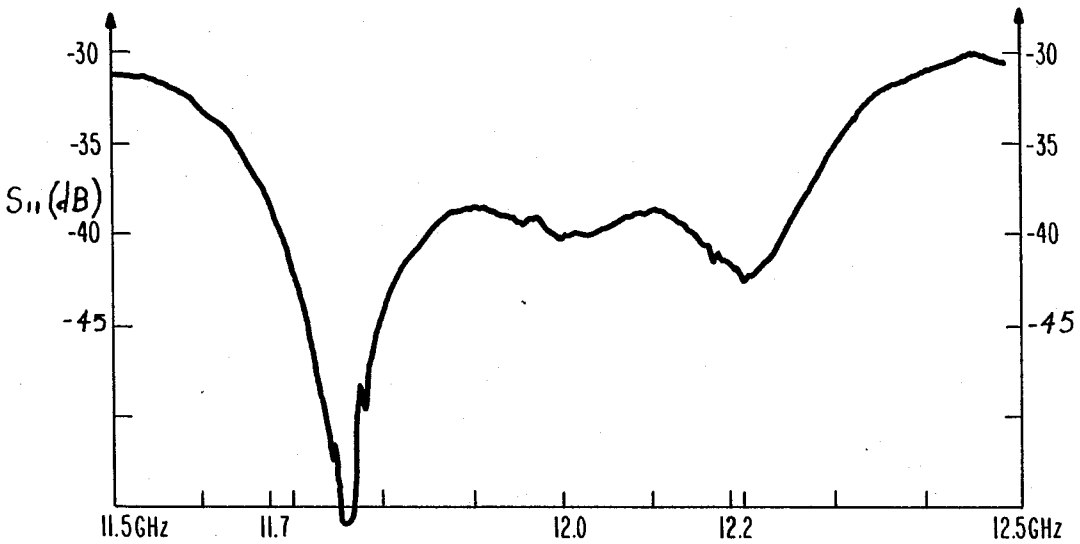
FIG. 4 is a plot of input return loss ($S_{11}$) of a termination according to the invention across a particular frequency band.
Figure 5:
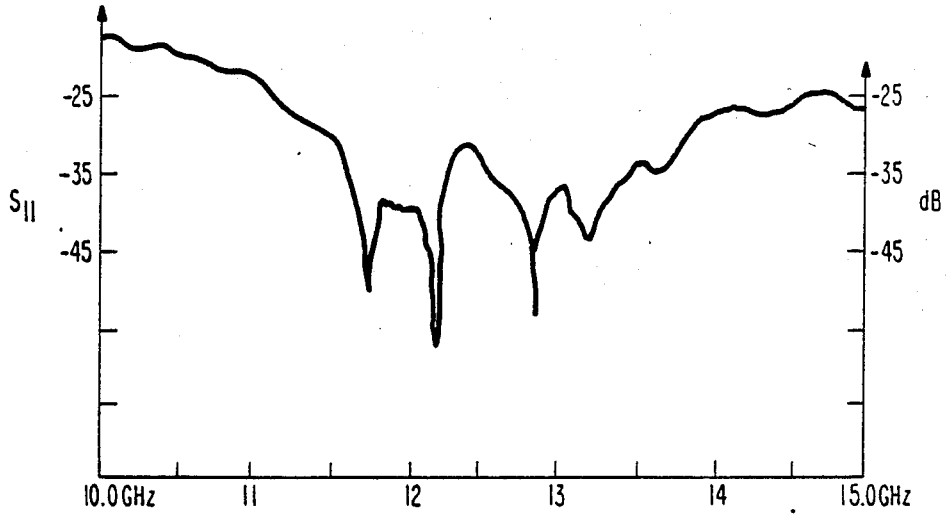
FIG. 5 is a plot across a greater frequency band.

FIG. 4 is a plot of input return loss ($S_{11}$) of a waveguide termination similar to that illustrated in FIG. 2*a* for a type WR-75X153 waveguide having interior height dimension of 0.153 inches (3.88 mm) and width of 0.75 inches (1.90 cm) and having an absorbent load wedge formed of the aforementioned Eccosorb MS-124 having a maximum height of 0.153 inches, corresponding to the height of the waveguide, a width dimension W equal to 0.35 inches (8.89 mm) which is slightly less than half the width of the guide, and a length L of 0.85 inch (2.16 cm). As illustrated in FIG. 4, the return loss is greater than 38dB in the 11.5 to 12.2 GHz frequency range of interest. FIG. 5 is a pot of $S_{11}$ of the aforementioned termination, and shows that the return loss is better than 20dB from at least 10 to 15 GHz.

Figure 6:
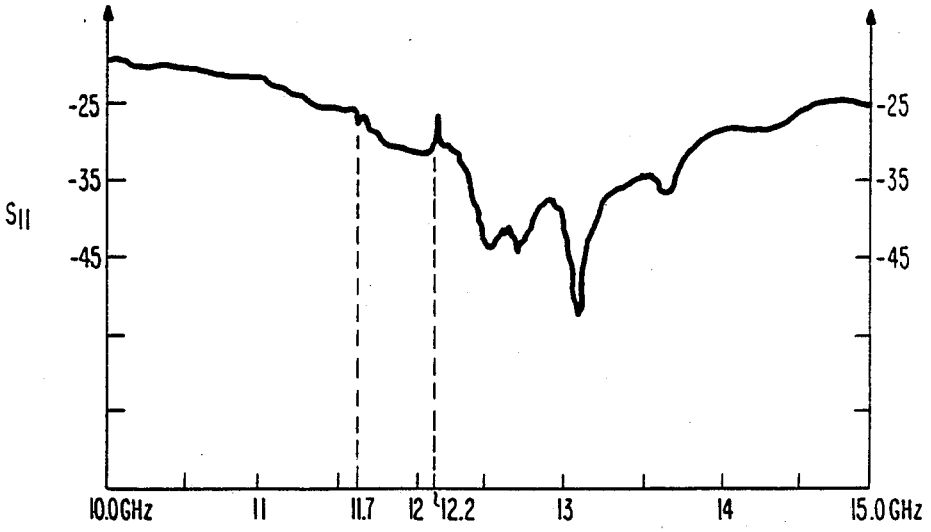
Fig. 6 PRIOR ART
FIG. 6 is a plot of input return loss of a termination with a centered absorber block.

FIG. 6 is a plot of a return loss of the aforementioned WR75X153 waveguide with the absorbing block centered in the waveguide rather than offset to the side. This substantially corresponds with the prior art arrangements. As can be seen, the return loss in the range of frequencies from 11.7 to 12.2 GHz ranges from about 26 to about 32 dB, which is not as good as in the inventive arrangement.

Other embodiments of the inventions will be apparent to those skilled in the art. Heat transfer from the asymmetrically located absorber material may be aided by thermally conductive septums, posts and the like, either with or without adhesive. The asymmetrically located absorber material may be tapered in two dimensions if desired to provide a more gradual energy absorption and better impedance match. It will be appreciated that a symmetric load arrangement according to the invention is particularly advantageous for formed-in-place absorbent material, as for example a lossy epoxy material which may be cured or hardened in a half waveguide section.

What is claimed is:

1. A waveguide arrangement, comprising:

a rectangular waveguide defined by first and second elongated conductive narrow walls equally spaced from a first plane of symmetry, and first and second conductive broad walls connecting the edges of said first and second narrow walls, said first and second broad walls being equally spaced from a second plane of symmetry orthogonal to said first plane of symmetry, the intersection of said first and second planes of symmetry defining an axis of said rectangular waveguide;

a conductive shorting wall oriented orthogonal to said axis and in contact with said first and second narrow walls and with said first and second broad walls for short-circuiting said rectangular waveguide at a shorting plane; and an energy absorbing termination including a wedge shaped energy absorber having a length in a direction parallel with said axis, a constant width approximately equal to half the width of said broad walls, and a height tapering monotonically over said length from a maximum dimension equal to the height of said narrow walls to a dimension substantially equal to zero, said wedge shaped energy absorber being located within said rectangular waveguide on one side of said first plane of symmetry with said maximum dimension nearest said shorting wall, leaving substantially the entirety of the corresponding region on the other side of said first plane of symmetry free of energy absorber.

2. An arrangement according to claim 1, wherein said energy absorbing termination includes a further energy absorber portion in the form of a block having a length, said constant width, and a height equal to said maximum dimension; said further energy absorber portion being located within said rectangular waveguide on said one side of said first plane of symmetry and between said energy absorbing termination and said conductive shorting wall.

3. An arrangement according to claim 2 wherein said further energy absorber portion having a first end which is in contact with said shorting wall and having a second end which is in contact with said wedge shaped energy absorber.

4. An arrangement according to claim 3 wherein said wedge shaped energy absorber is integrally formed in one piece with said further energy absorber portion.

5. An arrangement according to claim 1 wherein said wedge shaped absorber is adhesively fastened to said first narrow wall and to said second broad wall.

6. An arrangement according to claim 5 wherein said wedge shaped energy absorber is adhesively fastened to said shorting wall.

7. An arrangement according to claim 1 wherein any cross-section of said wedge shaped energy absorber in a plane parallel to said first plane of symmetry is a right triangle with a height equal to said maximum dimension, and a base having a dimension equal to said length.

8. An arrangement according to claim 7 wherein said wedge shaped energy absorber is oriented so that said base of said right triangle of any cross-section of said wedge shaped energy absorber lies flat against said second broad wall.

9. An arrangement according to claim 8, wherein said energy absorbing termination includes a further energy absorber portion in the form of a block having a length, said constant width, and a height equal to said maximum dimension said further energy absorber portion being located within said rectangular waveguide on said one side of said first plane of symmetry and between said energy absorbing termination and said conductive shorting wall.

10. A method for fabricating a waveguide arrangement, comprising the steps of:

forming a first half of an elongated rectangular waveguide including opposed narrow conductive walls spaced apart by broad conductive walls divided along a plane of symmetry which is parallel with said narrow walls of said rectangular waveguide and which passes through the axis of said waveguide;

forming a complementary half of said elongated rectangular waveguide;

fastening a tapered energy absorber in said first half so that no more than a small portion of said energy absorber extends past said plane of symmetry;

fastening together said first and complementary halves of said rectangular waveguide such that no more than said small portion of energy absorber extends into said complementary half of said rectangular waveguide.

11. A method according to claim 10 wherein said step of fastening said tapered energy absorber includes the steps of adhesively fastening said tapered energy absorber to a narrow wall of said first half and of adhesively fastening said tapered energy absorber to a wall orthogonal to said narrow wall.

12. A waveguide arrangement, comprising:

a rectangular waveguide defined by conductive first and second narrow walls equally spaced from a first plane of symmetry, and conductive first and second broad walls connecting the edges of said first and second narrow walls, said first and second broad walls being equally spaced from a second plane of symmetry orthogonal to said first plane of symmetry and being adapted to part along said first plane of symmetry, the intersection of said first and second planes of symmetry defining an axis of said waveguide;

a conductive shorting wall oriented orthogonal to said axis and in contact with said first and second narrow walls and with said first and second broad walls for short-circuiting said rectangular waveguide at a shorting plane;

a tapered energy absorber including wide and narrow portions, said tapered energy absorber being located within said rectangular waveguide with the bulk of said energy absorber on one side of said first plane of symmetry and oriented with said narrow portion of said tapered energy absorber facing away from said shorting wall, the corresponding location on the other side of said first plane of symmetry being substantially devoid of energy absorber material.

13. An arrangement according to claim 12 wherein said tapered energy absorber is shaped and located within said waveguide in such a fashion that at any cross-section of said waveguide taken parallel with said shorting wall at the location of said energy absorber, said energy absorber appears as a rectangle having at least a first side in contact with said second broad wall and a second side in contact with said first narrow wall.

14. An arrangement according to claim 13 wherein said energy absorber is adhesively fastened to said first narrow wall and to said second broad wall.

* * * * *